United States Patent [19]

Bishopp et al.

[11] 4,090,464

[45] May 23, 1978

[54] VANDAL GUARD SHEET

[76] Inventors: John H. Bishopp; George Spector, both of 3615 Woolworth Bldg., 233 Broadway, New York, N.Y. 10007

[21] Appl. No.: 590,351

[22] Filed: Jun. 25, 1975

[51] Int. Cl.[2] ..... G09F 7/12

[52] U.S. Cl. ..... 116/63 R; 40/594; 40/612; 40/615

[58] Field of Search ..... 40/135, 125 A, 125 F, 40/125 N, 125 R; 116/63 R, 114 R; 206/447, 449, 820; 428/203; 156/344; 35/40, 54, 61, 62, 63, 65, 66; 283/56; D96/12 J

[56] References Cited

U.S. PATENT DOCUMENTS

| | | | |
|---|---|---|---|
| 1,942,287 | 1/1934 | Heitz | 40/125 A |
| 2,549,419 | 4/1951 | Callahan | 40/135 |
| 2,581,762 | 1/1952 | Hesse | 40/125 F |
| 2,596,890 | 5/1952 | Dechert | 35/66 |
| 2,931,557 | 4/1970 | Loderhose | 40/135 X |
| 3,386,199 | 6/1968 | Nagatsuka | 40/135 |
| 3,497,969 | 3/1970 | Schwoegler | 35/66 |

FOREIGN PATENT DOCUMENTS

| | | | |
|---|---|---|---|
| 2,222,611 | 5/1972 | Germany | 35/66 |

*Primary Examiner*—Richard C. Queisser
*Assistant Examiner*—Joseph W. Roskos

[57] ABSTRACT

A sheet of clear plastic or vinyl type material having a clear adhesive covering the entire one side thereof so to adhere to a front of a roadway sign and prevent it from becoming defaced by vandals having spray cans of paint; the sheet being readily peeled off and replaced by a fresh sheet after being excessively defaced.

1 Claim, 6 Drawing Figures

10a
11
14
13
15
10b
14
10

3
3
10

CLEAR ADHESIVE 11
PEEL-OFF PLASTIZISED BACKING PAPER 12
CLEAR PLASTIC 10
10
10
19
20
19
13
14
15
14
10
19
19
10
16
10
14
17
18

VANDAL GUARD SHEET

This invention relates generally to sign accessories. More specifically, it relates to protective sign shields.

It is generally well known that in recent years there is an increased activity by vandals to deface roadway and street signs particularly with spray can paints which are very difficult and troublesome to be cleaned off afterwards, so that many such signs are needed to be replaced. Due to ever increasing costs to manufacturer new signs and install the same, many municipalities find this situation serious as such costs contribute to tax increases to the communities. Accordingly, there is a want for overcoming this situation.

It is therefore an object of the present invention to provide a vandal guard sheet for being placed against a front of such signs so to prevent the sign surface from becoming defaced.

Another object is to provide a vandal guard sheet which is made of clear plastic or vinyl so to be visible therethrough and which can be quickly and easily adhered to the sign so that spray paint is deposited upon the sheet instead upon the sign, and wherein the sheet thereafter is able to be readily peeled off and replaced by a fresh sheet.

Another object is to provide a vandal guard sheet which will additionally protect the sign from road tar and tree sap dripping thereon.

Still another object is to provide a vandal guard sheet which is adaptable for use on all types of road and highway signs including the new international traffic signs, the guard sheet being made up in sizes so to conform to the dimensions and shapes of the sign panels.

Other objects are to provide a vandal guard sheet which is simple in design, inexpensive to manufacture, rugged in construction, easy to use and efficient in operation.

These and other objects will be readily evident upon a study of the following specification and the accompanying drawing wherein.

Figures 1, 2, 3, 4, 5, 6:
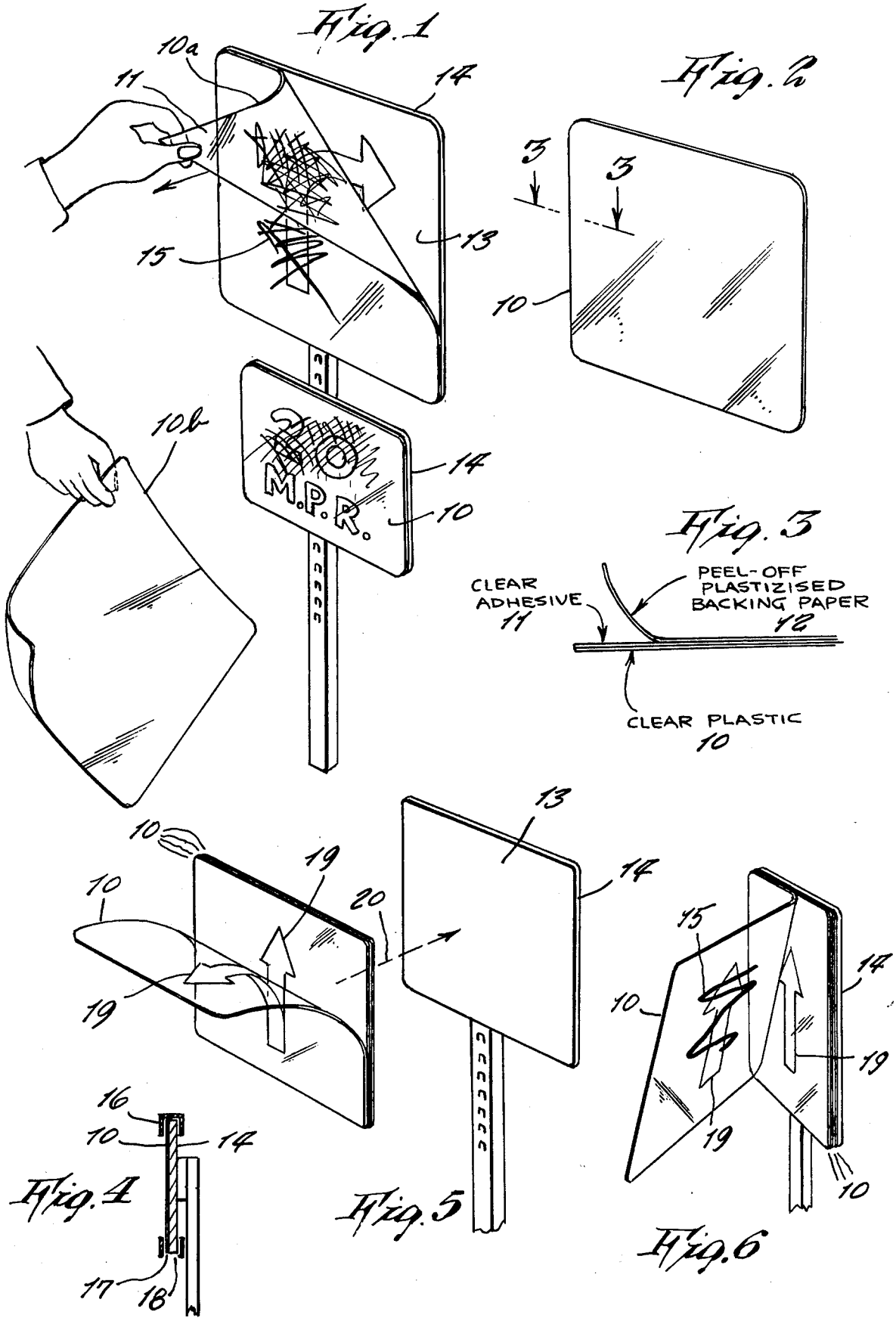
FIG. 1 is a perspective view of the present invention showing a defaced guard sheet being removed so to be replaced by a fresh guard sheet.
FIG. 2 is a view of a fresh guard sheet shown along.
FIG. 3 is an enlarged cross section on line 3—3 of FIG. 2 and showing the guard sheet construction.
FIG. 4 is a modified design of the invention in which a frame is additionally fitted on the sign so to enclose the edges of the guard sheet and thus deter attempt by vandals to peel off the sheet.
FIG. 5 shows a modified design of the invention wherein several guard sheets are applied on the sign, each guard sheet also being imprinted with the sign symbols, so that whenever a top one is defaced, it is peeled off and other fresh sheet is exposed, thus eliminate need for the road service man to carry extra sheet supply.
FIG. 6 shows the structure of FIG. 5, with top sheet being peeled off.

Referring now to the drawing in detail, and more particularly to FIGS. 1 through 3 at this time, the reference numeral 10 represents a vandal guard sheet according to the present invention wherein there is a sheet of clear plastic or vinyl type material which has its entire one side coated with a clear adhesive 11 which is covered by a protective backing paper 12 that can be peeled off so to expose the adhesive at such time that the guard is intended to be installed upon a front face or side 13 of a roadway sign panel 14. The sheet 10 is made in a same size and shape of the sign so to completely protect the sign face 13 from scrawling 15 (made by vandals upon signs) but which by employment of sheet 10 thus deface the sheet instead of the sign face, so that after the sign information is excessively obliterated, a highway or street sign maintainance crew can quickly and easily simply peel off the defaced sheet 10*a*, as shown in FIG. 1 and replace it by a fresh sheet 10*b*, thereby eliminating the difficult or impossible chore of removing such defacing from the sign face 13.

In FIG. 4, a modified design of the above described invention 10 additionally includes a frame 16 that fits over the sign so to enclose the edges 17 of the sheet 10 thereby eliminating easy access by vandals to grasp the sheet edge and peel it off. The frame may be channel shaped cross sectionally all around except on its lower edge which has an open slot 18 so to receive the sign and sheet. Screws, not shown, may be used to then firmly secure the frame to the sign panel, so to discourage easy removal of the frame by vandals.

In FIG. 5, a modified design of the invention includes a sign information 19 being imprinted on the sheet 10 instead on the face 13 of the sign panel 14, so that a change of information can be quickly applied to a sign panel without need of changing the panel itself. Also this form of the invention permits several such sheets being installed at one time on a sign panel as shown by arrow 20, so that when an outermost sheet becomes defaced, it can be peeled off by a sign service man, as shown in FIG. 6, who does not need to carry an extra sheet supply.

Thus different forms of the invention are provided.

While various changes may be made in the detail construction, it is understood that such changes will be within the spirit and scope of the present invention, as is defined by the appended claims.

What is claimed is:

1. A vandal guard sheet sign assembly formed from a plurality of parts comprising a flat sign panel part and a transparent plastic guard sheet part having a transparent adhesive on its inner face whereby said sheet is secured removably on said panel part by means of said adhesive, said panel and sheet parts being of similar dimensions, said assembly including visible indicia permanently enscribed on one of said parts and wherein the sheet and panel parts are in complete planar contact adhesively with each other, when said sheet part is secured to said panel part in further combination with a frame mounted about the periphery of the assembly, said assembly having an exposed bottom edge, whereby said frame is channel shaped in cross-section except for a bottom portion which fits over the bottom edge of said assembly, said bottom portion having spaced outer and inner legs adjacent to a lower opening therebetween providing access to said bottom edge for replacing a used guard sheet, said indicia being imprinted on said panel.

* * * * *